US005621891A

United States Patent [19]

Rühl et al.

[11] Patent Number: 5,621,891

[45] Date of Patent: Apr. 15, 1997

[54] DEVICE FOR GENERATING ANNOUNCEMENT INFORMATION

[75] Inventors: Hans-Wilhelm Rühl, Schwaig; Peter Meyer, Fürth/Bay, both of Germany

[73] Assignee: U.S. Philips Corporation, New York, N.Y.

[21] Appl. No.: 978,097

[22] Filed: Nov. 19, 1992

[30] Foreign Application Priority Data

Nov. 19, 1991 [DE] Germany ..... 41 38 016.9

[51] Int. Cl.[6] ..... G10L 3/00

[52] U.S. Cl. ..... 395/2.79; 395/2.21; 395/2.67

[58] Field of Search ..... 395/2, 2.1, 2.14–2.15, 395/2.21, 2.3, 2.65–2.68, 2.75–2.77, 2.86–2.87; 381/51, 77; 379/88

[56] References Cited

U.S. PATENT DOCUMENTS

| | | | |
|---|---|---|---|
| 3,928,722 | 12/1975 | Nakata et al. | 179/1 |
| 4,056,683 | 11/1977 | Suehiro | 395/2.87 |
| 4,255,618 | 3/1981 | Danner et al. | 395/2.79 |
| 4,400,582 | 8/1983 | Takeda et al. | 395/2.76 |
| 4,520,499 | 5/1985 | Montlick et al. | 395/2.76 |
| 4,796,216 | 1/1989 | Renner et al. | 381/51 |
| 4,825,385 | 4/1989 | Dolph et al. | 395/2.67 |
| 4,979,216 | 12/1990 | Malsheen et al. | 395/2.69 |
| 5,005,204 | 4/1991 | Deaett | 395/2.67 |
| 5,317,671 | 5/1994 | Baker et al. | 395/2.67 |

OTHER PUBLICATIONS

"Making Computers Talk; An Introduction to Speech Synthesis" Witten, 1986 Prentice Hall, Englewood Cliffs, NJ, pp. 59–64.

"An Experimental Speech Synthesis System with Prerecorded Words and Phrases for Local Weather Reports" Yasuhiro et al, NKH Laboratories Note, No. 246 Jan. 1980, pp. 1–14.

*Primary Examiner*—Tariq R. Hafiz

[57] ABSTRACT

The invention relates to a device for generating announcement information. When the complete announcement information is generated via natural speech information, a large storage capacity is required. The device aims to enable a plurality of different announcement information to be generated without requiring a large storage capacity. To this end, there is proposed a device for generating announcement information including an input unit, a storage unit for storing natural speech information, a speech generator for generating synthetic speech information and a multiplexer for combining the natural speech information and the synthetic speech information to form the announcement information.

13 Claims, 2 Drawing Sheets

DEVICE FOR GENERATING ANNOUNCEMENT INFORMATION

BACKGROUND OF THE INVENTION

The invention relates to a device for generating announcement information.

A device of this kind is required, for example for information systems as customarily used for telephone information or transport schedule information systems. Announcement information may then consist of a basic sentence, for example "This is the telephone information . . . , please wait", different key words, for example in the form of different city names, being insertable in the basic sentence at the position of the void denoted by the dots. The basic sentences and the necessary key words can be both stored as natural speech in a storage unit. This is an intricate operation requiring a large amount of storage space, for example, if the number of possible key words were great. Moreover, it is difficult to pronounce the key words so that they can be inserted into the basic sentence without discontinuities. In fact if a particular key word were to be combined with different basic sentences,or even at different positions in a single basic sentence, each such occurrence could necessitate a different pronounciation.

It is an object of the invention to provide a device for generating announcement information which allows for a variety of different anouncement information to be generated without requiring a large amount of storage space.

SUMMARY OF THE INVENTION

This object is achieved by a device for generating announcement information in accordance with the invention which comprises an input unit, a storage unit for storing natural speech information, and a speech generator for generating synthetic speech information, there being provided a multiplexer for combining the natural and the synthetic speech information so as to form the announcement information.

The invention is based on the recognition of the fact that frequently recurrent basic sentences can be stored in the storage unit as natural speech information, whereas announcement information which is to be frequently changed can be artificially generated by a speech generator. The synthetic speech information generated by the speech generator can be exactly manipulated in respect of duration, rhythm, accentuation and fundamental frequency variation and can be optimally inserted into the natural speech information. This results in a substantial reduction of the required storage space, because merely the basic sentences need be stored as natural speech information, whereas the synthetic speech information can be individually and instantaneously input by the input unit. A further advantage consists in that the number of words formed from the synthetic speech information is not limited.

An announcement system that can be used, for example for telephone announcement services etc. is obtained in that the device is conceived to generate at least one basic sentence consisting of speech blocks which are stored as natural speech information in the storage unit, and of key words which are formed from the synthetic speech information and which can be inserted between individual speech blocks.

Simple combination of the natural and the synthetic speech information is ensured in that the natural speech information is stored in the storage unit in encoded form, the synthetic speech information generated by the speech generator being encoded in conformity with the code of the natural speech information.

When information on the fundamental frequency variation of the natural speech information is stored in the storage unit, this information can be taken into account by the speech generator for generating the synthetic speech information to be inserted into the natural speech information. As a result, the fundamental frequency variation of the synthetic speech information can be conceived so that no discontinuities occur at the transitions between natural and synthetic speech information.

The element required for outputting the announcement information are limited when an output unit comprising an output memory and a digital-to-analog converter is provided for outputting the announcement information.

Simple output control is ensured when the output unit can be controlled by the input unit.

The intelligibility and naturalism of the announcement information is substantially improved when the natural speech information originates from only one speaker.

The overall intelligibility and the naturalism of the announcement information is further improved when the speech generator contains a speech model which is based on the speech data of the speaker of the natural speech information. The impression of a change of speaker is thus avoided.

BRIEF DESCRIPTION OF THE FIGURES

Further aspects and advantages of the invention will be described in detail hereinafter with reference to the embodiments shown in the Figures.

Therein.

DESCRIPTION OF PREFERRED EMBODIMENTS

Figure 1:
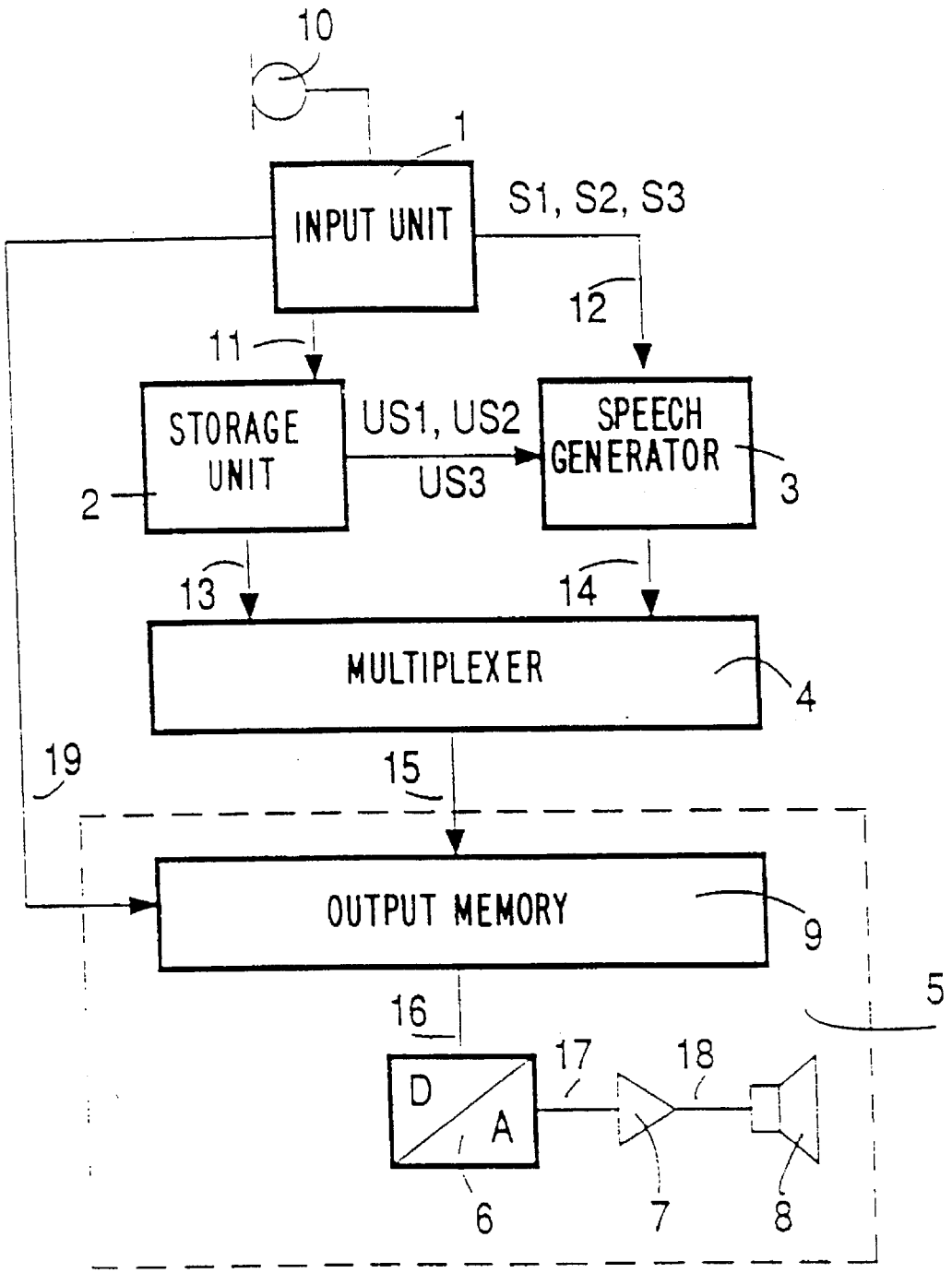
FIG. 1 shows an embodiment of a device for generating announcement information.

The device for generating announcement information as shown in FIG. 1 basically consists of an input unit 1, a storage unit 2, a speech generator 3, and a multiplexer 4. Natural speech information 11, for example in PCM coded form, can be stored in the storage unit 2, the natural speech information being input by a speaker, for example by means of a microphone 10 which can be connected to the input unit 1. For transmitting such natural speech the input unit 1 has an analog audio channel, an analog-to-PCM converter and activation apparatus not separately shown that enable the analog input, the converting, and the storage in storage unit 2. Moreover, data management for the data base thus being built up from natural speech is provided in a conventional way, for example, in that each stored natural speech unit or message has an appropriate number or label, for allowing easy retrieval.

In another embodiment, the natural speech may have been recorded off-line, so that the input unit need not have analog to PCM conversion, but only retrieval control for storage unit 2.

In addition to the above, input unit 1 operates to control speech generator 3, for example in that it has full alphanumerical keyboard and associated display screen to apply word information 12 to speech generator 3, the word being formed by keying its constituent characters. In certain cases, it could be feasible that certain or all insert words were already stored as character code strings, so that only a selection was necessary from input unit 1. The storage as character codes necessitates much less space than storage as a sequence of PCM codes. Now, the speech generator 3 generates synthetic speech information 14 from the word information 12. Via the multiplexer 4, said synthetic speech information is combined with the natural speech information 13 so as to form the announcement information 15. The announcement information 15 is output via an output unit 5 which comprises an output memory 9, an analog-to-digital converter 6, an amplifier 7 and a loudspeaker 8.

One or more so-called basic sentences are stored in coded form in the storage unit 2. Such basic sentences consist of individual blocks of speech, so-called key words being insensible between individual blocks of speech. The locations for inserting are indicated by appropriate data, such as a flag. These flags that are also transmitted to multiplexer 4, then control the switch-over of multiplexer 4 from the natural speech from storage unit 2 to the speech generator 3. If necessary, such switchover is also signalled back to the human operator, such as by an on-screen message (interconnection not shown). This signals the operator to enter the insert word. At the end of the insert word the operator could switch back the multiplexer 4 to the storage unit 2, such as by actuation the "return/enter" key. The key words may be, for example names of cities or also numbers. For example, the sentence "the express train from S1 to S2 is expected to be S3 minutes late" contains the individual speech block B1 "The express train from", B2 "to", B3 "is expected to be", and B4 "minutes late", as well as different names of cities as the key words S1 and S2 and a number as the key word S3. Input of different key words S1, S2, S3 enables generation of different anouncement information 15.

The operation for generating announcement information 15 will be described hereinafter. Via the input unit 1, for example a keyboard with a display screen, first a desired basic sentence is selected from the basic sentences stored in the storage unit 2. The storage unit 2 also stores information US1, US2, US3 concerning the fundamental frequency variation or slope at the boundaries between the speech blocks B1, B2, B3, B4 and the key words S1, S2, S3. Via the input unit 1, the key words S1, S2, S3 are input in arbitrarily coded form, for example as normal text. The key words S1, S2, S3 are applied as word information 12 to the speech generator 3 which generates the synthetic speech information 14 from the key words S1, S2, S3. In order to avoid discontinuities at the transitions between natural and synthetic speech, causing difficult to understand and/or unnatural announcement information 15, during the generation of the synthetic speech information 14 the corresponding parameters are adapted, to the fundamental frequency variation of the respective speech blocks B1, B2, B3, B4 by the information US1, US2, US3. This prevents irritation of the listener to the announcement information due to unnatural accentuation, thus also improving the acceptance of the announcement information. Under the control of the information US1, US2, US3 concerning the pitch variation, the speech generator 3 generates the synthetic speech information 14 in encoded form from the word information 12. The synthetic speech information 14 as well as the natural speech information 13 is applied to the multiplexer 4 which combines the speech blocks B1, B2, B3, B4, i.e. the basic sentence, consisting of the natural speech information, and the key words S1, S2, S3, consisting of the synthetic speech information 14 so as to form the announcement information 15 as shown in detail in FIG. 2. The representation of the synthetic speech is as an appropriate sequence of PCM codes. Next, the announcement information 15 is written into the output memory 9 of the output unit 5. The output signal 16 of the output memory 9 is a PCM signal which is first converted into an analog signal 17 by the digital-to-analog converter 6. The analog signal 17 is amplified by the amplifier 7 so as to be applied to the loudspeaker 8 as an output signal 18.

Figure 2:
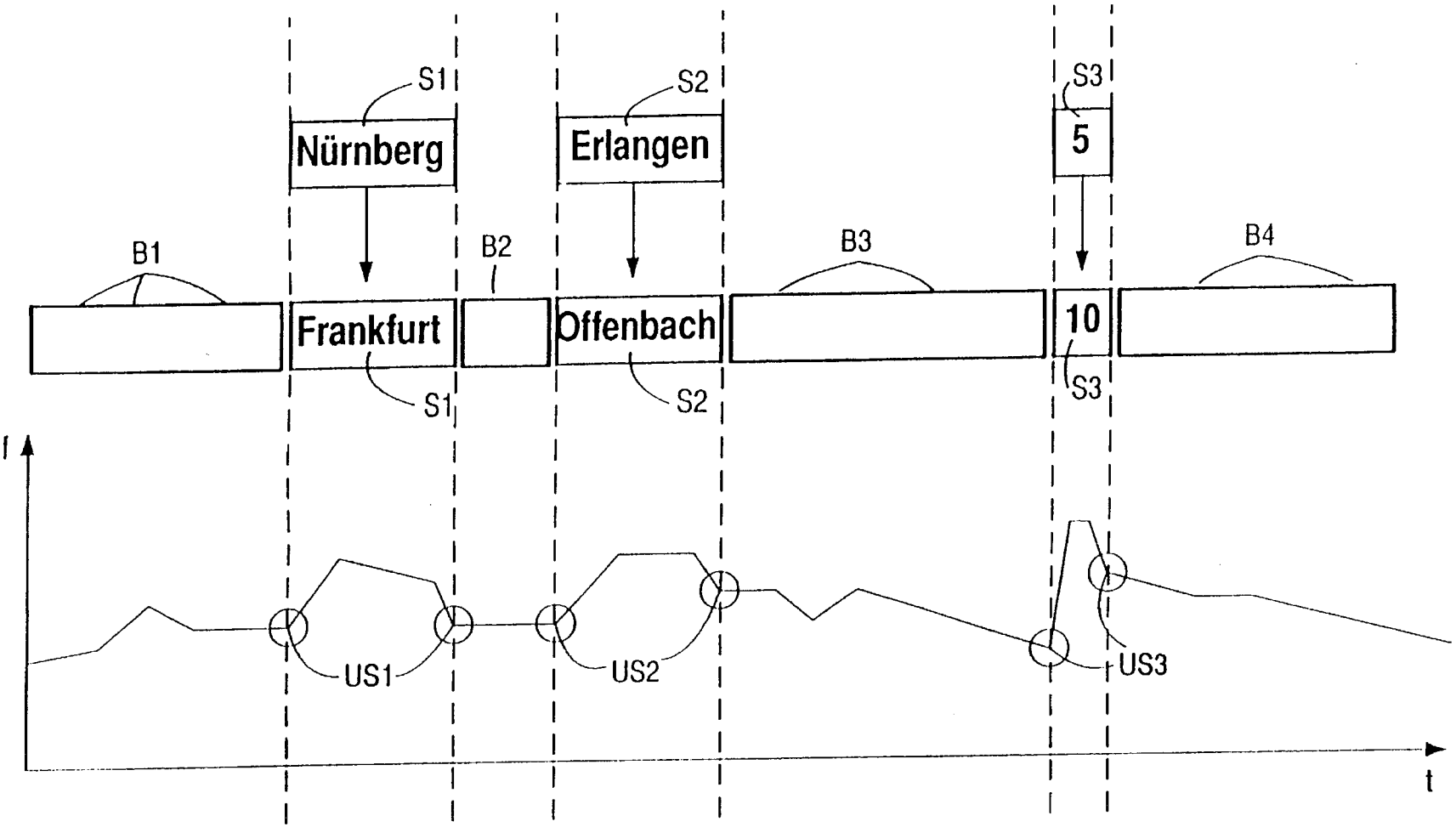
FIG. 2 shows an example of the composition of announcement information from natural and synthetic speech information.

FIG. 2 shows an example of announcement information. The upper pan of FIG. 2 shows a basic sentence which is formed by speech block B1, B2, B3, B4 and which can be supplemented by key words S1, S2, S3. The lower pan of FIG. 2 shows the fundamental frequency variation f as a function of time t for the exemplary sentence "Der Eilzug yon Frankfurt nach Offenbach hat voraussichtlich 10 Minuten Verspäiterung" (the expres train from Frankfurt to Offenbach is expected to be 10 minutes late) shown in the upper pan of FIG. 2.

The basic sentence the express train from S1 to S2 is expected to be S3 minutes late shown in FIG. 2 contains the speech block B1, B2, B3, B4 which are stored as natural speech information 11 in the storage unit 2 (FIG. 1). The key words Nürnberg, Frankfurt=S1, Erlangen, Oftenbach=S2 and 5, 10=S3 are inserted as required into the basic sentence. Different announcement information can thus be generated. At the transitions between the speech blocks B1, B2, B3, B4 and the key words S1, S2, S3 information US1, US2, US3 concerning the fundamental frequency variation is stored in the storage unit for each basic sentence. This is emphasized in FIG. 2 with circles. On the one hand, an unnatural impression of the announcement information is avoided and at the same time the intelligibility of the announcement is substantially better than if it were generated completely synthetically.

The advantage of the invention resides on the one hand in the reduced storage capacity requirements, because only the natural speech information 11 forming the basic sentences need be stored. Moreover, arbitrary key words can be "edited" by using the input unit 1, simple input being possible via merely a keyboard. Thus, the number of key words is not restricted. The synthetic speech information 14 can be exactly manipulated in respect of duration, rhythm, accentuation and fundamental frequency variation, it being possible to adapt said manipulation, by way of the information US1, US2, US3, optimally to the respective basic sentences. The overall intelligibility and naturalism of the announcement information 15 is improved when the speech generator 3 contains a speech model based on speech data of the speaker of the natural speech information 11. The impression of a change of speaker is thus also avoided.

We claim:

1. A device for generating speech information signal, comprising:

input means for generating a first control signal and a second control signal that are mutually exclusive in time;

storage means for storing natural speech information in the form of first time-sequential strings each having one or more distinct words;

speech generating means for, under control of said second control signal, generating synthetic speech information as further time-sequential strings each having one or more further distinct words; and multiplexing means coupled to said storage means and to said speech generating means for receiving said natural speech information and said synthetic speech information and for selectively outputting on a word-by-word basis one of said natural speech information and said synthetic speech information in response to said first control signal and said second control signal, respectively, to generate said speech information signal, while being blocked from switching-over between said storage means and said speech generating means other than at the end of said time-sequential string.

2. The device as claimed in claim 1, wherein said natural speech information includes a speech block and wherein said synthetic speech information includes a key word.

3. The device as claimed in claim 2, wherein said speech information signal includes a sentence including a plurality of speech blocks and a key word interposed between two of said speech blocks.

4. The device as claimed in claim 1, wherein said natural speech information is stored in said storage means in encoded form and wherein said synthetic speech information generated by said speech generating means is encoded in conformity with said code of said natural speech information.

5. The device as claimed in claim 4, wherein said storage means stores frequency variation information for a junction between one of said speech blocks and an adjacent one of said key words.

6. The device as claimed in claim 5, wherein said speech generating means responsive to said frequency variation information, changes a parameter of said synthetic speech information.

7. The device as claimed in claim 1, wherein said storage means stores frequency variation information for a junction between one of said speech blocks and an adjacent one of said key words.

8. The device as claimed in claim 7, wherein said speech generating means responsive to said frequency variation information, changes a parameter of said synthetic speech information.

9. The device as claimed in claim 8, wherein said output means is responsive to said input means.

10. The device as claimed in claim 1, further including output means coupled to said multiplexing means for outputting said speech information signal, said output means including an output memory and a digital-to-analog converter.

11. The device as claimed in claim 10, wherein said speech generating means includes a speech model based on speech data from said one speaker.

12. The device as claimed in claim 1, wherein said natural speech information is derived from one speaker.

13. The device as claimed in claim 1, further including a microphone coupled to said input means for receiving said natural speech information.

* * * * *